United States Patent [19]

Konopko

[11] 4,440,304

[45] Apr. 3, 1984

[54] PROTECTIVE PADS WITH SELF-LOCKING PANELS AND BLANK THEREFOR

[75] Inventor: Matthew S. Konopko, Chicago, Ill.

[73] Assignee: Stone Container Corporation, Oak Brook, Ill.

[21] Appl. No.: 358,334

[22] Filed: Mar. 15, 1982

Related U.S. Application Data

[63] Continuation-in-part of Ser. No. 262,193, May 11, 1981, Pat. No. 4,372,446.

[51] Int. Cl.[3] ..... B65D 81/10

[52] U.S. Cl. ..... 206/586; 229/1.5 R; 229/DIG. 1

[58] Field of Search ..... 206/586; 229/16 R, 1.5 R, 229/DIG. 1

[56] References Cited

U.S. PATENT DOCUMENTS

| | | | |
|---|---|---|---|
| 2,509,468 | 5/1950 | Anderson, Jr. | 206/586 X |
| 3,063,613 | 11/1962 | McClive | 206/586 X |
| 3,220,683 | 11/1965 | Doll | 206/586 X |
| 3,655,112 | 4/1972 | Jeffers | 206/586 |
| 3,684,636 | 8/1972 | Rothrock, Jr. et al. | 206/586 X |
| 3,843,038 | 10/1974 | Sax | 206/586 |
| 3,900,156 | 8/1975 | Clark, Jr. | 229/DIG. 1 |
| 3,955,677 | 5/1976 | Collingwood | 229/DIG. 1 |
| 4,372,446 | 2/1983 | Konopko | 206/586 |

*Primary Examiner*—William Price
*Assistant Examiner*—Gary E. Elkins
*Attorney, Agent, or Firm*—Silverman, Cass & Singer

[57] ABSTRACT

A corner pad for protection of crated objects, such as appliances, furniture or the like, is formed from an integral blank of corrugated paperboard. The pad has multiple-ply walls and a multiple-ply base including two leg formations joined to form a generally L-shaped structure. One of the legs has a mitered base panel which includes a tip formed by the intersection of the mitered edge with another edge of the panel, and the tip is releasably compressed by coplanar engagement with a base panel in the other leg formation to releasably self-lock the engagement of the panels within the corner configuration.

Self-locking pads having particular corner configurations comprising wall angles of 120 or 150 degrees can be conveniently erected from single-piece blanks in two preferred embodiments.

25 Claims, 11 Drawing Figures

PROTECTIVE PADS WITH SELF-LOCKING PANELS AND BLANK THEREFOR

CROSS REFERENCE TO RELATED APPLICATION

This is a continuation-in-part of copending application Ser. No. 262,193 filed May 11, 1981, now U.S. Pat. No. 4,372,446 entitled "SELF-LOCKING PROTECTIVE PADS AND BLANK THEREFOR", which is incorporated herein by reference.

BACKGROUND OF THE INVENTION

This invention generally relates to protective corner pads for crated objects, such as appliances, furniture or the like. More particularly, this invention relates to improved protective pads formed from corrugated paperboard with a novel self-locking feature when assembled.

Shipment of furniture, appliances and other objects in conventional shipping crates or cartons often requires protective pads at the corners of such containers, and sometimes, at other locations, in order both to protect the object and to reduce or prevent shifting of the object in the carton during shipment. Protective pads have been developed using integral corrugated paperboard blanks designed to be folded into useful configurations for protective pad utilization.

Corrugated paperboard blanks capable of being formed into protective pads are widely used and enjoy substantial commercial preference. For example, U.S. Pat. No. 2,509,468 describes a corrugated paperboard corner pad assembled from a blank by folding to provide a rectangular base having four thicknesses, and vertical, triangular sides at right angles likewise having four thicknesses; each triangular side is provided with a notch and tongue to secure the folded corner configuration. Similarly, U.S. Pat. No. 3,843,038 describes a corner pad assembled from a corrugated paperboard sheet folded so that a three wall configuration of multiple-ply walls has one of the walls provided with locking tabs to secure the folded configuration. U.S. Pat. No. 3,655,112 describes a corner pad in which a sheet of corrugated paperboard is folded into generally double-paneled walls in which sections of a base are joined at mitered edges including a tongue and a notch respectively formed to lock the folded configuration.

The prior art devices identified have not been satisfactory for several cogent reasons. Generally, these have utilized complex configurations of panels with unduly complicated assembly thereof. Another deficiency has been lack of suitable thickness for the pad so that desirable pad protection could be achieved, especially for large, bulky and heavy objects or objects such as furniture made of wood which was easily damaged in shipment. Finally, the locking of the pad assembly after folding was not sufficiently reliable.

Another deficiency of prior art structures was the failure to provide a single foldable blank which could be assembled, selectively, either as a corner pad or an edge pad with equally desirable results.

SUMMARY OF THE INVENTION

According to this invention, a protective pad for a crated object such as an appliance, furniture or similar cargo, has a corner configuration of multiple-ply walls including a reliable, self-locking base structure. The base structure comprises a generally L-shaped configuration provided by two legs which are joined so that a tip formed by a mitered panel in one of the legs is releasably compressed by coplanar engagement with a panel forming one of the plies in the other leg. The tip is umcompressed in the fully erected corner configuration and the engagement of the panels is self-locking because their disengagement requires imposed recompression of the tip.

In the preferred construction, the corner pad is erected from an integral blank of paperboard folded to provide triple-ply thickness for the walls and base. Pads having obtuse corner angles, for example 120 degrees or 150 degrees, can be erected from such integral blanks.

Additionally, the base can be constructed so that a wedge member projects from one of the leg members into the other leg member between its plies to provide further self-locking of the erected corner configuration of the pad.

The same paperboard blank for the corner pad can also be folded to provide an edge pad. This edge pad is formed by incomplete erection of the same blank from which the corner pad is erected. The edge pad can be installed selectively to provide cushioning on generally right angular surfaces.

DESCRIPTION OF THE PREFERRED EMBODIMENTS

Figure 1:
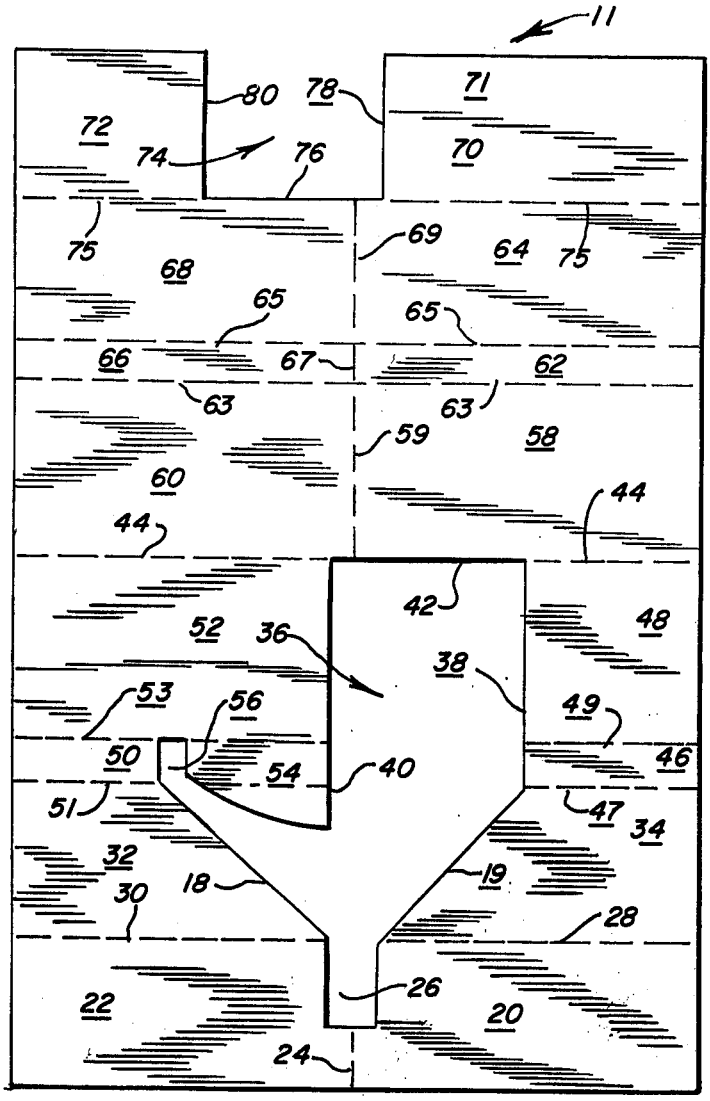
FIG. 1 is a plan view of a single-piece blank formed in accordance with the aforementioned copending application.
Figure 2:
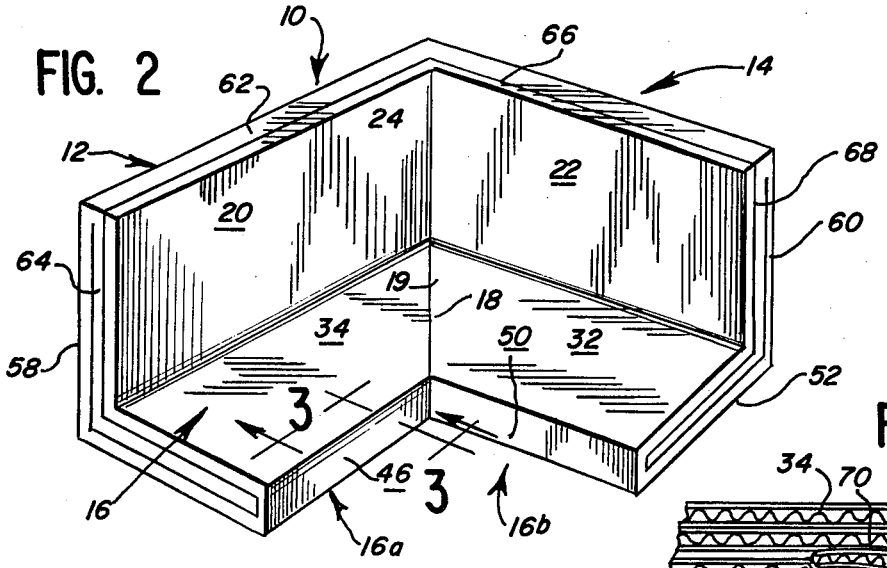
FIG. 2 is a perspective view of a corner pad erected from the blank shown in FIG. 1.

As described in copending application Ser. No. 262,193, the protective corner pad illustrated in FIG. 2 is erected from a single-piece blank 11 which is illustrated in FIG. 1. Corner pad 10 includes two, multiple-ply, vertical wall members 12 and 14 which form a substantially right angle; each of wall members 12 and 14 is joined at substantially right angle to multiple-ply base member 16. Base 16 is generally L-shaped in configuration to include legs 16*a* and 16*b*. As shown in FIG. 2, legs 16*a* and 16*b* are joined at mitered edges 18 and 19, preferably at substantially 45 degrees, to produce the L-shaped configuration of base 16.

The sheet material for blank 11 can be any suitably rigid but foldable material. Preferably, blank 11 is stamped or die cut from a web of corrugated or solid-fiber paperboard which can be folded into the self-locking configuration of corner pad 10.

Referring to FIG. 1, blank 11 is a generally rectangular sheet of corrugated paperboard with both layers of fluting oriented generally parallel to the longer dimension of the rectangular sheet. Blank 11 is designed to enable both vertical walls 12 and 14 and base to form triple-thickness for the erected corner pad 10. However, additional panels can be provided in a blank similar to blank 11 in order to produce a corner pad having four-ply or greater thickness.

As seen in FIG. 1, at one end of blank 11 interior wall panels 20 and 22 are substantially aligned and integrally hinged endwise by score or fold line 24. Preferably, a narrow cutout 26 between interior wall panels 20 and 22 is aligned with score line 24 to facilitate their folding at a right angle to form the interior plies of vertical walls 12 and 14, respectively, in the erected corner pad 10.

Panels 20 and 22 are integrally hinged by respective score lines 28 and 30 to respective interior base panels 32 and 34. Panels 32 and 34 are mitered preferably 45 degrees at respective opposing edges 18 and 19 positioned in generally mirror-image alignment. Panels 32 and 34 are foldable to form the mitered interior walls of legs 16*b* and 16*a*, respectively, in the erected corner pad 10.

Mitered edges 18 and 19 are formed as cut lines which partially define cutout 36 extending inwardly along generally parallel cut lines 38 and 40. Cut lines 38 and 40 intersect terminal cut line 42 which is in alignment and interrupts score line 44 which generally bisects the length of blank 11.

As shown in FIG. 1, panel 46 is integrally hinged to interior base panel 34 and external base panel 48 by respective score lines 47 and 49 positioned on opposite edges of hinge panel 46. Panel 46 facilitates folding of exterior base panel 48 through 180 degrees in order to underlie interior base panel 34 to form leg 16*a* of base structure 16 in the erected corner pad 10. Similarly, panel 50 is integrally hinged to interior base panel 32 and exterior base panel 52 by respective score lines 51 and 52. Thus, exterior base panel 52 is folded 180 degrees to underlie interior base panel 32 to form leg 16*b* of base 16 in the erected corner pad 10.

Figure 3:
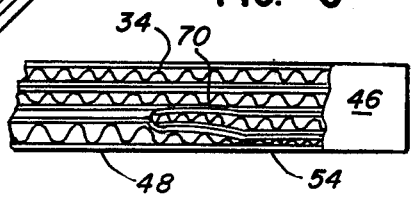
FIG. 3 is a sectional view taken along lines 3—3 in FIG. 2, showing a locking wedge formation in the base structure of the corner pad.

In contrast to exterior base panel 48, exterior base panel 52 is somewhat larger and preferably has an integral projection 54 extending toward cut line 18. Projection 54 is defined between cut line 40 and notch 56 which also defines the interior end of hinge panel 50. As shown in FIG. 3, projection 54 provides a frictionally-locking wedge or tongue between adjacent panels 48 and 70 of leg 16*a* for erection of corner pad 10.

Referring again to FIG. 1, exterior base panel 48 is integrally hinged by score line 44 to exterior wall panel 58 which is integrally hinged endwise by score line 59 to exterior wall panel 60. Panels 58 and 60 form the outside walls of vertical walls 14 and 12, respectively, in the erected corner pad 10.

Narrow panel 62 is integrally hinged to exterior wall panel 58 and intermediate wall panel 64 by respective score lines 63 and 65 formed on opposite edges of hinge panel 62. Hinged panel 62 is hinged endwise to hinge panel 66 along score line 67. Intermediate wall panel 64 is hinged endwise to intermediate wall panel 68 along score line 69. Intermediate wall panels 64 and 68 are folded to form respective intermediate walls in face-to-face contact between the exterior and interior wall panels of vertical walls 12 and 14.

Intermediate base panels 70 and 72 are formed at the opposite end of blank 11 from panels 20 and 22. Panels 70 and 72 are separated endwise by a rectilinear cutout 74, and are hinged to intermediate wall panels 64 and 68, respectively, by score line 75. Cutout 74 is dimensioned so that the length of cut line 76, being the distance between the opposing edges of panels 70 and 72 defined by respective cut lines 78 and 80, is at least as long as, and preferably equal to, cut lines 78 and 80. This enables coplanar, right angular abutment of panels 70 and 72 upon their relative rotation in the erected corner pad 10, as more fully described in the aforementioned copending application.

When blank 11 is erected to form corner pad 10 as illustrated in FIG. 2, legs 16*a* and 16*b* of the base are rotated into right angular, coplanar configuration, with abutment of the mitered edges 18 and 19 on the interior base panels 34 and 32, respectively. Such folded erection results in the forced insertion of Wedge 54 into frictional engagement between exterior base panel 48 and intermediate base panel 70, as best shown in FIG. 3, to create self-locking of the fully erected corner pad 10.

A modified corner pad, in accordance with this invention, is illustrated with reference to FIGS. 4–7, in which the erected pad forms two corners of an equilateral hexagon. Thus, in this particular corner configuration the walls intersect one another at approximately 120°, in contrast to the 90° angle between the walls 12 and 14 of corner pad 10 illustrated in FIG. 2. In addition, this pad includes a further self-locking feature as described hereinafter.

Figure 4:
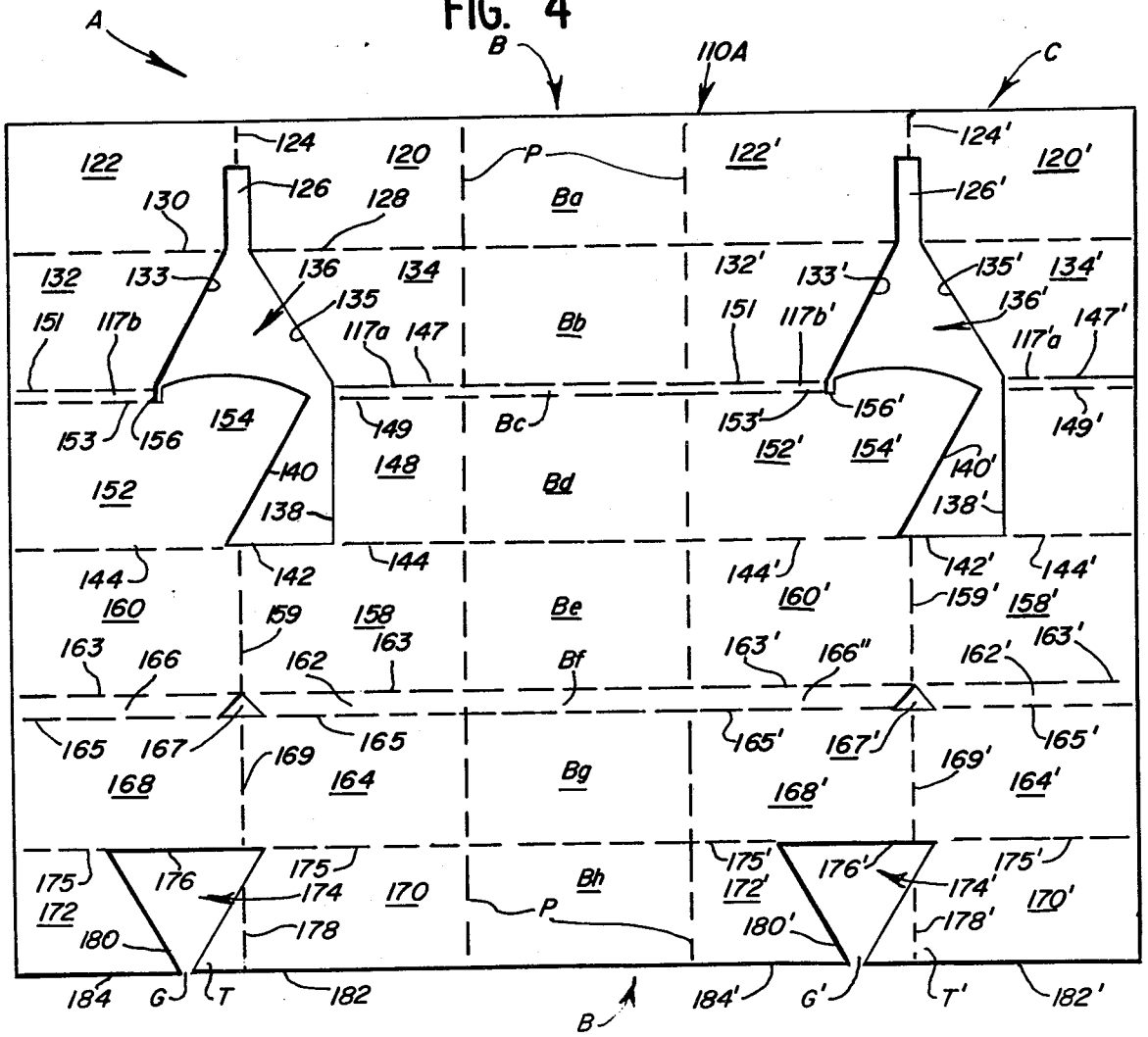
FIG. 4 is a plan view of a single-piece blank formed in accordance with this invention.
Figure 5:
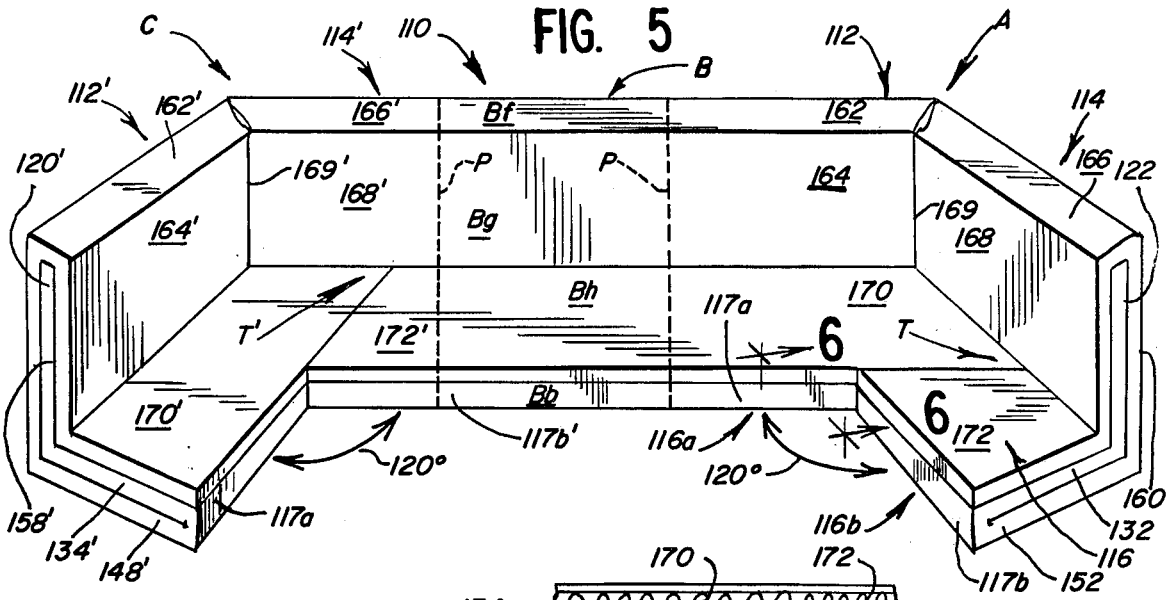
FIG. 5 is a perspective view of a corner pad erected according to the invention from the blank shown in FIG. 4.

The corner pad illustrated in FIG. 5 is designated generally by the reference character 110. Pad 110 is designed to include two 120° corner configurations generally designated A and C which have respective vertical wall members 112 and 114' connected by bridge structure B. Bridge structure B can be provided with conventional "perfing" P to allow separation of the two corner configurations. Corner configuration A will be described in further detail and the corresponding parts of corner configuration C are designated by primed reference numerals in FIGS. 4 and 5.

Figure 6:
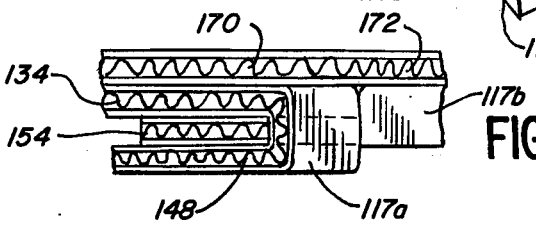
FIG. 6 is a sectional view taken along lines 6—6 in FIG. 5, showing a locking wedge formation in the base structure of the corner pad.
Figure 7:
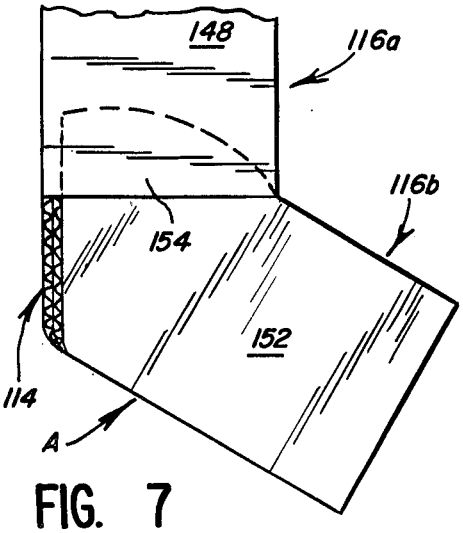
FIG. 7 is a bottom plan view of the erected corner pad of FIG. 5, showing the angle formed by the legs of the base structure and showing the wedge formation in hidden line.

Referring again to FIG. 5, corner configuration A includes the two, multiple-ply vertical wall members 112 and 114 which intersect to form an angle of approximately 120°. Each of the wall members 112 and 114 are joined at a generally right angle to multiple-ply base member generally designated by reference character 116. Base 116 has a modified L-shape in which legs 116*a* and 116*b* intersect to form an angle of approximately 120° between respective hinge panels 117*a* and 117*b* as illustrated in FIGS. 5–7.

Pad 110 can be erected from a single-piece blank 110A, illustrated in FIG. 4, which can be fabricated as previously described in reference to blank 11. While blank 110A is designed for erection of a triple-thickness pad, additional panels can be provided in a blank 110A in order to produce a pad having greater thickness than pad 110. As illustrated in FIG. 4, the panel groups which are erected to form corner configurations A and C are arranged in parallel and connected by bridge panels Ba-Bh connecting endwise the inner, aligned panels in each panel group. The panel groups A and C are identical but are not arranged to form mirror-images as the erected pad 110 more clearly illustrates in FIG. 5. Thus, for example, base panels 170 and 172' are connected by bridge panel Bh defined by perfing P as clearly illustrated in both FIGS. 4 and 5.

Referring again to FIG. 4, the arrangement of panels within the panel group erected to form corner configuration A will now be described. In the blank 110A intermediate wall panels 120 and 122 are hingedly connected endwise by score or fold line towards 124. Preferably, a narrow cutout 126 between intermediate panels 120 and 122 is aligned with score line 124 to facilitate their folding to form the intermediate ply of the triple-ply veritcal wall members 112 and 114, respectively, in corner configuration A of erected pad 110.

Panels 120 and 122 are integrally hinged by respective score lines 128 and 130 to respective intermediate base panels 132 and 134. Intermediate base panels 132 and 134 are mitered at respective opposing edges 133 and 135 which form an angle of approximately 60° between them. Preferably, each of edges 133 and 135 form an angle of approximately 60° with respective score lines 130 and 128 so that edges 133 and 135 are in generally mirror-image alignment. Panels 132 and 134 are foldable to form the mitered intermediate base panels of triple-ply legs **116*b* and 116*a*, respectively, in the erected pad 110. The mitered edges 133 and 135 are fabricated as cut lines which partially define cutout 136 which extends inwardly and is also bound by cut lines 138, 140, and terminal cut line 142. Cut line 140 forms an angle of approximately 60° with cut line 142 which is an alignment and interrupts score line 144 which generally bisects the width of blank 110A**.

Hinge panel **117*a* is integrally hinged to intermediate base panel 134 and exterior base panel 148 by respective score line 147 and 149 positioned on opposite edges of hinge panel 117*a*. Hinge panel 117*a* facilitates folding of exterior base panel 148 through 180° in order to underlie intermediate base panel 134 in leg 116*a* of the erected pad 110. Similarly, hinge panel 117*b* is integrally hinged to intermediate base panel 132 and exterior base panel 152 by respective score lines 151 and 153. Thus, exterior base panel 152 is folded 180° to underlie intermediate base panel 132 in leg 116*b* of erected pad 110**.

Exterior base panel 152 is somewhat larger than exterior base panel 148 and additionally has an integral projection 154 extending toward edges 133 and 135. Projection 154 is partially defined between cut line 140 and notch 156 which also defines the interior end of hinge panel **117*b*. As shown in FIG. 6, projection 154 provides a frictionally-locking wedge between adjacent panels 148 and 134 of leg 116*a* in the erected corner pad 110. Wedge 154 is shown in hidden line beneath exterior base panel 148 of corner configuration A in FIG. 7**.

Referring again to FIG. 4, exterior base panel 148 is integrally hinged by score line 144 to exterior wall panel 158 which is integrally hinged endwise by score line 159 to exterior wall panel 160. Panels 158 and 160 form the outside walls of vertical walls 112 and 114, respectively, in the erected corner pad 110.

Narrow panel 162 is integrally hinged to exterior wall panel 158 and interior wall panel 64 by respective score lines 163 and 165 formed on opposite edges of hinge panel 162. Hinge panel 162 is separated endwise from hinge panel 166 by small triangular cutout 167, which eases compressive folding of the two hinge panels 162 and 166 toward each other during erection of pad 110. Intermediate wall panel 64 is hinged endwise to intermediate wall panel 68 along score line 69. Interior wall panels 164 and 168 are folded to form the respective interior panels of triple-ply vertical walls 112 and 114.

Interior base panels 170 and 172 are formed at the opposite side of blank 110A from panels 120 and 122. Panels 170 and 172 are aligned and separated endwise by a triangular cutout 174 and are hinged to respective interior wall panels 164 and 168 by score line 175. One edge of cutout 174 is defined by a cutline 176 which is aligned with and interrupts score line 175. Preferably, cutout 174 is formed as a slightly truncated equilateral triangle so that the two remaining edges 178 and 180 are cut lines which also define the opposing edges of panels 170 and 172, respectively. Cut lines 178 and 180 each intersect cut line 176 at approximately 60° but do not intersect each other so that a gap G is produced at the side of the blank defined between the side edges 182 and 184 of respective panels 170 and 172. Cutout 174 is positioned offset from score line 169 so that panel 170 is larger than panel 172 in order for panel 170 to form a bridge from leg **116*a* into leg 116*b* which self-locks the erected pad 110** as more fully described hereinafter.

Pad 110 can be erected from blank 110A by folding 180° panels 122, 120, Ba, 122', 120', 132, 134, Bb, 132', and 134' as a unit, so that such folding is inward along score line 151 and its extension 147' and downward along score line 153 and its extension 149', until such panels lie in face-to-face contact above panels 152, 148, Bd, 152', 148', 160, 158, Be, 160', and 158', respectively, thus positioning hinge panels **117*b*, 117*a*, Bc, 117*b'*, and 117*a'* at substantially right angle to such face-engaged panel unit. The resulting face-engaged panels form a two-ply unit upon which the remaining panels can be folded 180° inward along score line 165—165' and downward along score line 163—163' so that intermediate base panel 132 is sandwiched in contact between exterior base panel 152 and interior base panel 172, with intermediate wall panel 152 similarly sandwiched in face-to-face contact between exterior wall panel 160 and interior wall panel 168. Thus, folded bridge panel Ba is sandwiched in face-to-face contact between bridge panel Be and Bg, to produce the triple-ply bridge between wall members 112 and 112' of the erected pad 110 as illustrated in FIG. 5**.

Figure 9:
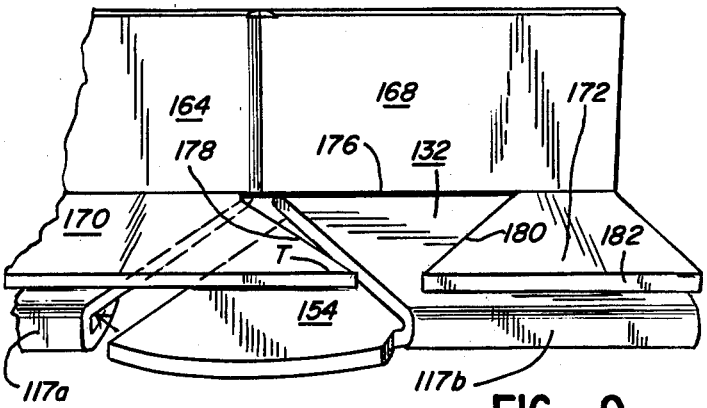
FIG. 9 is a fragmentary perspective view of the edge protective pad which can be further folded to complete the erection of the corner pad shown in FIG. 5.
Figure 8:
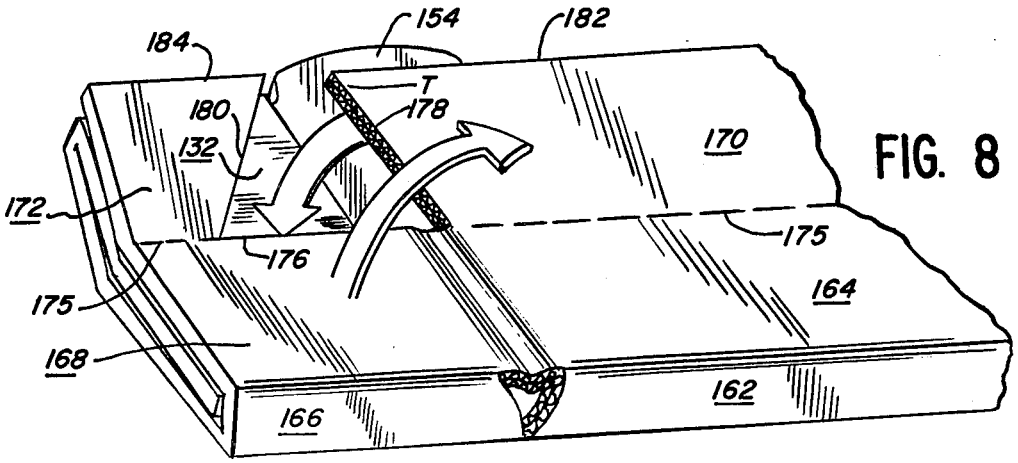
FIG 8 is a perspective view of the corner pad partially folded toward the completed pad shown in FIG. 5.

The triple-ply configuration shown in the fragmentary view of FIG. 8 can now be further folded along score line 175 so that base legs **116*a* and 116*b* are positioned at substantially right angle to the aligned walls 112 and 114, respectively, as shown in FIG. 9. At this point, the configuration shown in FIG. 9** forms a very effective edge pad without further folding, for use along a single edge of a crated object.

To complete assembly of the hexagonal corner configuration A from the pad configuration shown in FIG. 9, walls 112 and 114 are folded approximately 60° on score line 169 to form an angle of approximately 120°; such folding results in the 60° relative rotation of base legs **116*a* and 116*b* within the same general plane so that the interior base panel 170 is rotated until its mitered edge 178 abuts interior wall panel 168 at its lower edge defined by cut line 176. Such rotation brings the side edge 182 of interior base panel 170 into abutment with the mitered cut line 180 on interior base panel 172, so that the portion of interior base panel 179 extending between mitered cut line 178 and side edge 182 occupies the space formed by cutout 174 prior to such rotation. Moreover, during such rotation, the tip T formed at the intersection of cut line 178 and edge 182 of interior base panel 170 becomes compressed upon sliding engagement with cut line 180 of interior base panel 172 until full rotation of 60° relieves such compression of the tip upon its abutment of panel 168 with general congruent positioning of tip T abutting the intersection of cut lines 180 and 176. A counter-rotation to disjoin legs 116***a* and 116*b* requires recompression of tip T in a reversal of the sliding engagement with mitered cut line 180; this required recompression of tip T serves to self-lock the joining of legs 116*a* and 116*b* to form the modified L-shape as illustrated in FIGS. 5 and 7. The self-locking of legs 116*a* and 116*b* maintains the erection of the entire corner configuration A generally, but the self-locking is releasable when sufficient recompression of tip T is imposed for deliberate disassembly of corner configuration A or the entire pad 110.

The described locking rotation of legs 116*a* and 116*b* also results in the forced insertion of wedge 154 into frictional engagement between exterior base panel 148 and intermediate base panel 134, as best illustrated in FIGS. 6 and 9. The frictional securement of the forced wedge 154 between the adjacent panels 148 and 134 normally prevents inadvertent withdrawal and produces additional self-locking of the joined legs 116*a* and 116*b* and the corner configuration A until a deliberate withdrawal of wedge 154 releases its frictionally locked insertion.

In contrast to the width of hinge panel 46 which must span all three of the plies of leg 16*a* in pad 10 as illustrated in FIGS. 2 and 3, hinge panel 117*a* cf pad 110 can be slightly greater than only two of the plies 148 and 134 of leg 116*a* which can enable greater frictional self-locking of wedge 154 with the elimination of the cushioning of a third ply within the spanned width of hinge panel 117*a*.

Figure 10:
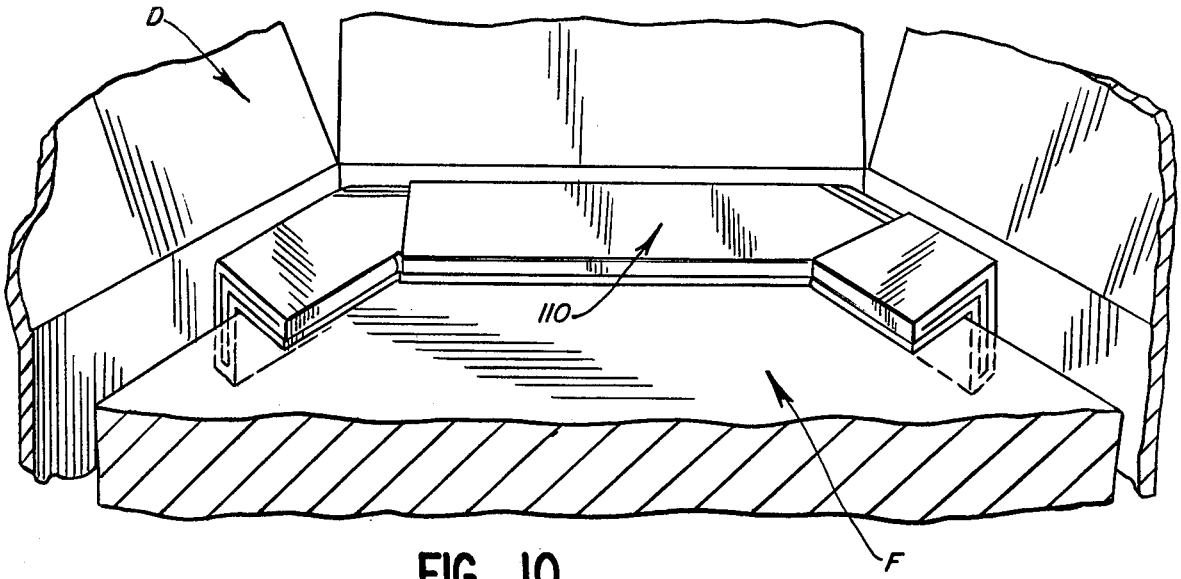
FIG. 10 is a fragmentary, perspective view of the corner pad shown in FIG. 5 in position upon an object at two corners of a shipping crate.

FIG. 10 illustrates the use of pad 110 which is oriented similar to the bottom view of FIG. 7 and positioned upon a wrapped article of furniture, or the like, to be protectively cushioned at two hexagonally configured corners of a shipping container D. Pad 110 preferably engages both container D and wrapped object F to provide a cushioning gap or clearance therebetween at the surfaces of each corner configuration A and C in the illustrated triple thickness. Pad 110 can conveniently provide a typical clearance of approximately three-quarters inch or greater, governed by the gauge of the original blank employed.

Variation in the distance between corner configurations A and C can be conveniently accommodated merely by variation in the length of panels in the bridge structure B. In addition, a single hexagonal corner configuration can be erected from a blank similar to blank 110A merely by omitting or detaching the bridge structure B and panel group for erecting corner configuration C. A suitable blank for erecting three or more corner configurations can be produced by addition of one or more panel groups similar to those for erecting corner configurations A and C, with or without the inclusion of additional bridge structure.

Figure 11:
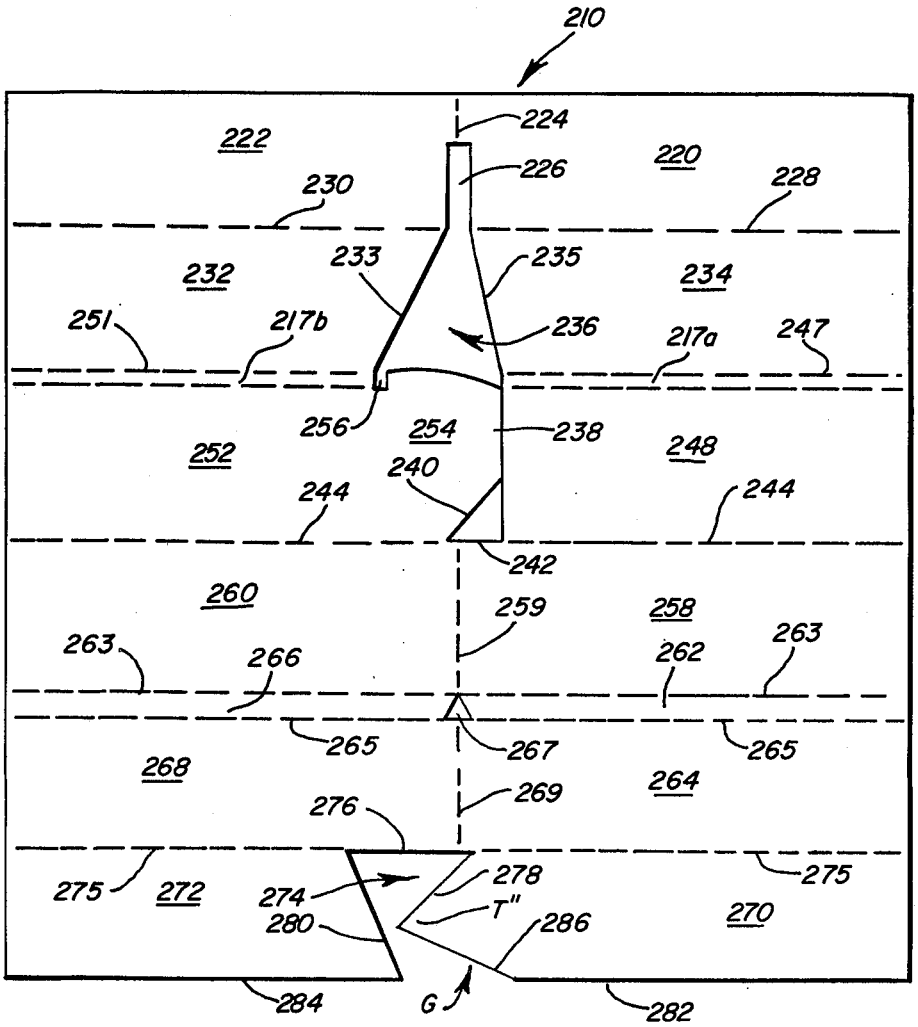
FIG. 11 is a plan view of a modified, single-piece blank in accordance with this invention.

FIG. 11 illustrates a modified blank 210 in accordance with this invention, for erection of a pad having a corner configuration in which the wall members intersect to form an approximately 150° angle, generally corresponding to one angle of an equilateral octagon. Blank 210 is erected by folding in the manner described in reference to blank 110A; however, interior base panels 270, and 272 are relatively rotated only approximately 30°. Thus, cutout 274 is shaped so that miter cut line 278 forms an angle of approximately 30° with cut line 276 and these two cut lines will abut upon 30° relative rotation of interior base panels 270 and 272. The miter cut line 280 of interior base panel 272 intersects cut line 276 to form an angle of approximately 60°, and therefore, a second miter cut line 286 on interior base panel 270 intersects miter cut line 278 to form an angle of approximately 60° resulting in the abutment of cut lines 280 and 286 on respective interior base panels 272 and 270 upon their 30° relative rotation. Consequently, the portion of interior base panel 270 lying between cut lines 278 and 286 will be in generally congruent abutment of the 60° angle between cut lines 280 and 276 after the 30° rotation which produces the self-locking compression of tip T″ in the a manner previously described with reference to erected pad 110.

Variations from the embodiments specifically described and illustrated can be constructed within the scope of the claimed invention. For example, when both interior base panels and exterior base panels are each provided with a sufficiently tight self-locking tip formation, wedge structure can be omitted without sacrifice in maintaining the erection of the corner configurations of the protective pads.

I claim:

1. A pad for protection of a crated object formed from a single blank of foldable sheet material, said pad comprising:

A. a pair of multiple-ply wall formations intersecting to form two walls of a corner configuration;

B. a multiple-ply base formation connected to both of said walls at substantially right angle in said corner configuration;

C. said base formation being of generally L-shaped configuration having conjoined first multiple-ply leg and second multiple-ply leg formations; and D. at least one said ply in at least one of said leg formations including a mitered base panel having a tip formation formed by the intersection of at least one mitered edge with at least one other edge of said panel, said tip formation being slidably and releasably compressed in the direction of coplanar engagement thereof with a second base panel forming one of said plies in said other leg formation, to releasably lock engagement of said panels within said corner configuration while allowing release of said locked engagement by slidable, coplanar withdrawal of said tip formation from said engagement.

2. The pad as claimed in claim 1, wherein said mitered base panel is hinged along one side edge thereof to one of said wall formations, and wherein said mitered edge of said mitered base panel abuts the other of said wall formations, whereby said mitered base panel forms a bridge extending from said one leg formation into the other leg formation.

3. The pad as claimed in claim 2, wherein said second base panel includes a mitered edge abutting a second side edge of said first mentioned mitered base panel.

4. The pad as claimed in claim 3, wherein said mitered edge and said second side edge of said first mitered base panel intersect at said abutment of said other wall formation.

5. The pad as claimed in claim 3, wherein said first and second mitered base panels form interior panels substantially in face-to-face contact with respective intermediate base panels sandwiched between said interior base panels and respective exterior base panels to form said respective leg formations in at least three-ply thickness.

6. The pad as claimed in claim 1, wherein said mitered base panel and said second base panel form interior panels substantially in face-to-face contact with respective intermediate base panels sandwiched between said interior base panels and respective exterior base panels to form said respective leg formations in at least three-ply thickness.

7. The pad as claimed in claim 1, wherein at least one of said leg formations includes wedge means in releasable locking engagement between plies of said other leg formation.

8. The pad as claimed in claim 5 or 6, wherein at least one of said leg formations includes wedge means formed on said exterior base panel thereof, said wedge means being in releasably locking engagement between plies of said other leg formation.

9. The pad as claimed in claim 1, wherein said walls generally intersect at an angle between 90 and 180 degrees.

10. The pad as claimed in claim 1, wherein said walls intersect to form an approximately 120 degree angle.

11. The pad as claimed in claim 1, wherein each of said walls is at least three-ply in thickness.

12. The pad as claimed in claim 1, wherein said pad includes at least two of said corner configurations integrally connected to one another.

13. The pad as claimed in claim 1 or 2, wherein said tip is formed by the intersection of said mitered edge with a second mitered edge of said panel.

14. The pad as claimed in claim 13, wherein said mitered edge intersect to form an approximately 30 degree angle.

15. The pad as claimed in claim 14, wherein said walls generally intersect to form an approximately 150 degree angle.

16. The pad as claimed in claim 15, wherein at least one of said leg formations includes wedge means in releasably locking engagement between plies of said other leg formation.

17. A foldable, generally rectangular blank of paperboard material or the like having a plurality of hingedly connected panels for erecting a protective pad in a generally corner configuration, comprising:

A. at least two panel groups, each of said panel groups including a plurality of wall panels foldable into a face-to-face relationship for forming a multiple-ply wall formation in said corner configuration;

B. each of said panel groups including a plurality of base panels foldable into a face-to-face relationship to form a respective multiple-ply leg formation, said leg formations being connected to form a generally L-shaped base formation connected also to said wall formations in said erected corner configuration;

C. at least one of said base panels in each of said panel groups being aligned in endwise relation to the other of said base panels along one edge of said blank; and D. a cutout separating said aligned base panels, said cutout being partially defined by a mitered edge formed on each of said aligned base panels and further defined by a cut line substantially aligned with and interrupting a fold line forming respective side edges of said respective aligned base panels on respective sides thereof interior to said blank.

18. The blank as claimed in claim 17, wherein said cutout is positioned so that said aligned base panels have unequal length to enable the longer of said aligned base panels to form a bridge extending from one of said leg formations into the other leg formation.

19. The blank as claimed in claim 17 or 18, wherein said cutout is shaped so that said respective mitered edges intersect said cut line to form a truncated equilateral triangle opening to form a gap in said edge of said blank.

20. The blank as claimed in claim 17 or 18, wherein said cutout is partially defined by a second mitered edge formed on one of said aligned base panels.

21. The blank as claimed in claim 18, wherein said cutout is further partially defined by a second mitered edge formed on the longer of said aligned base panels.

22. The blank as claimed in claim 21, wherein said first and second mitered edges intersect to form an approximately 30 degree angle.

23. The blank as claimed in claim 17, wherein said plurality of base panels includes at least three base panels for forming said base formation in at least three-ply thickness.

24. The blank as claimed in claim 17 or 23, wherein at least one of said base panels in at least one of said panel groups includes a wedge formation positioned for releasably locking engagement between base panels in said erected corner configuration.

25. An edge protective pad having a generally right angular configuration erected from the blank as claimed in claim 17 wherein said plurality of wall panels in each of said panel groups is folded into face-to-face relationship to form respective multiple-ply wall formations in endwise alignment, said plurality of base panels in each of said panel groups being folded into face-to-face relationship to form respective base formations in endwise alignment, said aligned wall formations being folded approximately 90 degrees in hinged relation to said aligned base formations to form said erected right angular configuration.

* * * * *